US009181950B2

(12) United States Patent
Ota et al.

(10) Patent No.: US 9,181,950 B2
(45) Date of Patent: Nov. 10, 2015

(54) MOTOR-DRIVEN COMPRESSOR

(75) Inventors: Takayuki Ota, Kariya (JP); Kazuo Murakami, Kariya (JP); Ken Suitou, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 416 days.

(21) Appl. No.: 13/431,508

(22) Filed: Mar. 27, 2012

(65) Prior Publication Data

US 2012/0251358 A1 Oct. 4, 2012

(30) Foreign Application Priority Data

Mar. 31, 2011 (JP) ..... 2011-076998

(51) Int. Cl.

| | |
|---|---|
| ***F04C 23/00*** | (2006.01) |
| ***F01C 21/00*** | (2006.01) |
| ***F01C 21/10*** | (2006.01) |
| *F04C 18/02* | (2006.01) |

(52) U.S. Cl.

CPC ..... *F04C 23/008* (2013.01); *F01C 21/10* (2013.01); *F04C 18/0215* (2013.01); *F04C 2230/604* (2013.01); *F04C 2240/30* (2013.01); *F04C 2240/80* (2013.01); *F04C 2270/12* (2013.01); *F04C 2270/19* (2013.01)

(58) Field of Classification Search

CPC ..... F04C 2240/30; F04C 23/008; F04C 18/0215; F04B 53/001; F04B 53/002; F04B 53/003

USPC ..... 417/363; 248/559, 562; 267/136, 137, 267/139, 140

See application file for complete search history.

(56) References Cited

U.S. PATENT DOCUMENTS

| | | | | | |
|---|---|---|---|---|---|
| 4,734,323 | A | * | 3/1988 | Sato et al. | 428/317.3 |
| 5,272,285 | A | * | 12/1993 | Miller | 181/202 |
| 5,997,258 | A | * | 12/1999 | Sawyer et al. | 417/312 |

(Continued)

FOREIGN PATENT DOCUMENTS

| | | | |
|---|---|---|---|
| JP | 61-218784 A | | 9/1986 |
| JP | S61218784 | * | 9/1986 |

(Continued)

OTHER PUBLICATIONS

Gujarat Cork & Rubber PVT.Ltd., www. gujaratcork.com, 2008.*

(Continued)

*Primary Examiner* — Charles Freay
*Assistant Examiner* — Lilya Pekarskaya
(74) *Attorney, Agent, or Firm* — Sughrue Mion, PLLC

(57) ABSTRACT

A motor-driven compressor that suppresses the transmission of vibration and noise to the exterior, while obtaining heating performance that is sufficient for use in a heat pump. The motor-driven compressor includes a compressor mechanism, which compresses a refrigerant, and a motor mechanism, which actuates the compressor mechanism. The motor-driven compressor further includes an inner housing, which accommodates the compressor mechanism and the motor mechanism in a sealed state, and an outer housing, which accommodates the inner housing. The outer housing includes a mounting portion that can be mounted to another member. A first intermediate member is arranged between the inner housing and the outer housing. The first intermediate member includes anti-vibration and thermal insulation properties.

9 Claims, 4 Drawing Sheets

(56) References Cited

U.S. PATENT DOCUMENTS

| | | | | |
|---|---|---|---|---|
| 6,264,446 | B1 * | 7/2001 | Rajendran et al. | 418/55.6 |
| 6,619,933 | B2 * | 9/2003 | Ikeda | 417/410.1 |
| 6,669,452 | B2 * | 12/2003 | Ogawa et al. | 417/360 |
| 7,398,855 | B2 * | 7/2008 | Seel | 181/202 |
| 8,079,443 | B2 * | 12/2011 | Keller | 181/292 |
| 2002/0131878 | A1 | 9/2002 | Ogawa et al. | |
| 2007/0059189 | A1 * | 3/2007 | Nakano et al. | 417/415 |

FOREIGN PATENT DOCUMENTS

| | | | |
|---|---|---|---|
| JP | H1-106697 | U | 7/1989 |
| JP | 5-65876 | A | 3/1993 |
| JP | 6-288353 | A | 10/1994 |
| JP | 8-261150 | A | 10/1996 |
| JP | 11-294365 | A | 10/1999 |
| JP | 2002-276554 | A | 9/2002 |
| JP | 2004-232523 | A | 8/2004 |
| JP | 2007-16601 | A | 1/2007 |
| JP | 2009-103100 | A | 5/2009 |
| JP | 2009-138697 | A | 6/2009 |
| JP | 2009-221969 | A | 10/2009 |

OTHER PUBLICATIONS

Korean Office Action issued Jun. 7, 2013 in corresponding Korean Patent Application No. 2012-0030518.

Communication dated Apr. 28, 2014, issued by the State Intellectual Property Office of the People's Republic of China in corresponding Application No. 201210084818.7.

* cited by examiner

MOTOR-DRIVEN COMPRESSOR

BACKGROUND OF THE INVENTION

The present invention relates to a motor-driven compressor.

Japanese Laid-Open Patent Publication No. 11-294365 discloses a motor-driven compressor of the prior art. The motor-driven compressor includes a compressor mechanism, which compresses a refrigerant, and a motor mechanism, which actuates the compressor mechanism. The motor-driven compressor includes an inner housing, which accommodates the compressor mechanism and the motor mechanism in a sealed state, and an outer housing, which accommodates the inner housing.

A spring, which supports the inner housing, is arranged in the outer housing of the motor-driven compressor. Thixotropic fluid is filled in a void formed between the outer housing and the inner housing. The outer housing includes a mounting portion that allows for mounting to another member.

The spring and thixotropic fluid function to suppress the transmission of vibration and noise from the compressor mechanism and motor mechanism to the exterior of the motor-driven compressor.

In this prior art motor-driven compressor, the heat of the high-temperature and high-pressure refrigerant compressed by the compressor mechanism is transmitted via the inner housing and the spring to the outer housing and released to the exterior or absorbed via the inner housing by the thixotropic fluid. Accordingly, there is a tendency for the heat of the refrigerant to be easily decreased. Thus, for example, when the motor-driven compressor is used in a heat pump, the heating performance of the heat pump becomes insufficient.

SUMMARY OF THE INVENTION

Accordingly, the present invention provides a motor-driven compressor that suppresses the transmission of vibration and noise to the exterior, while obtaining sufficient heating performance when used in a heat pump.

One aspect of the present invention is a motor-driven compressor including a compressor mechanism that compresses a refrigerant. A motor mechanism actuates the compressor mechanism. An inner housing accommodates the compressor mechanism and the motor mechanism in a sealed state. An outer housing accommodates the inner housing. The outer housing includes a mounting portion that can be mounted to another member. A first intermediate member is arranged between the inner housing and the outer housing. The first intermediate member includes anti-vibration and thermal insulation properties.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First and second embodiments of the present invention will now be described with reference to the drawings.

First Embodiment

Figure 1:
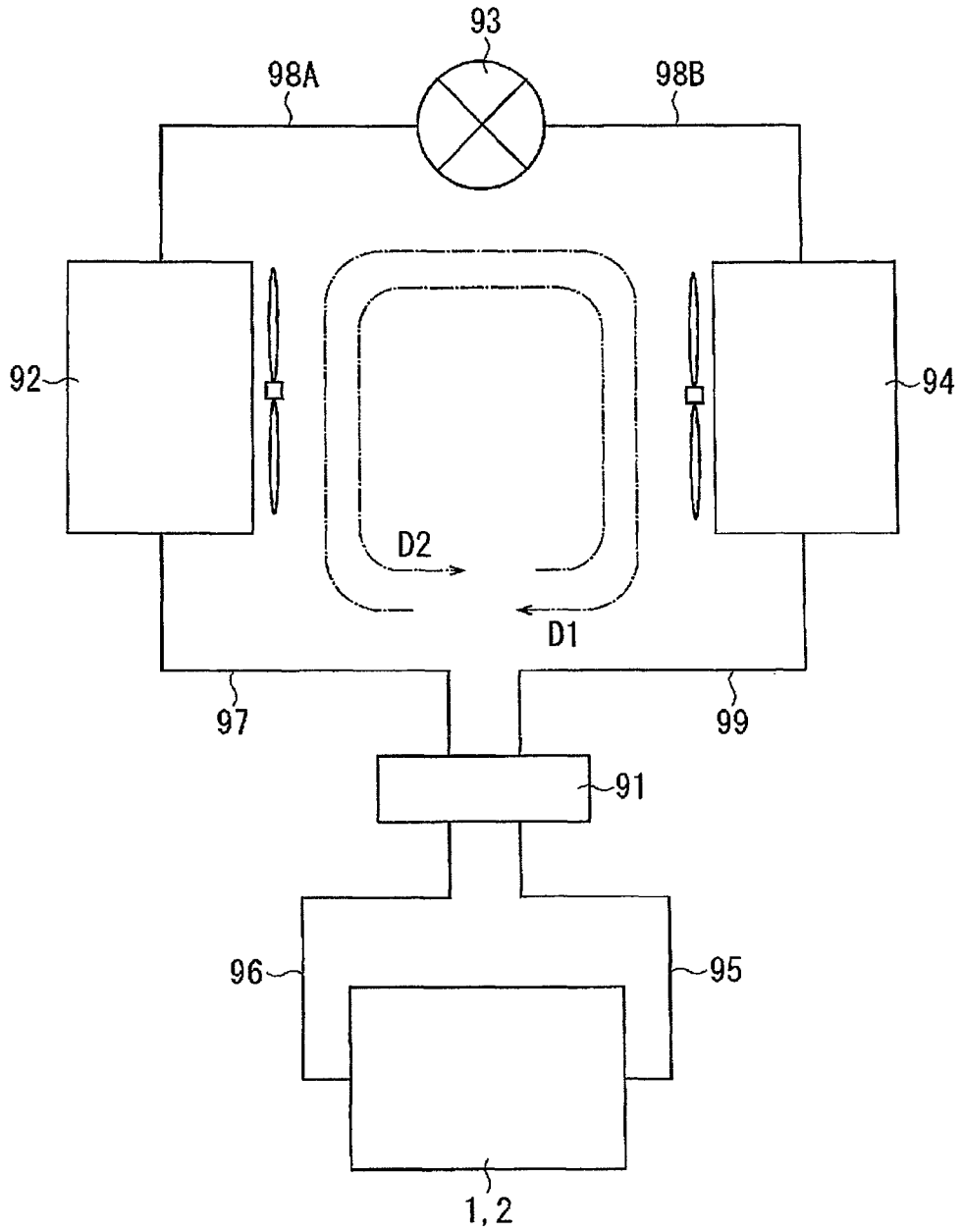
FIG. 1 is a block diagram of an air conditioner including a motor-driven compressor according to a first embodiment of the present invention.

Referring to FIG. 1, a motor-driven compressor 1 of the first embodiment is applied to an air conditioner installed in a vehicle to adjust the temperature of a passenger compartment. In addition to the motor-driven compressor 1, the air conditioner includes a switch valve 91, a passenger compartment exterior heat exchanger 92, an expansion valve 93, and a passenger compartment interior heat exchanger 94.

Figure 2:
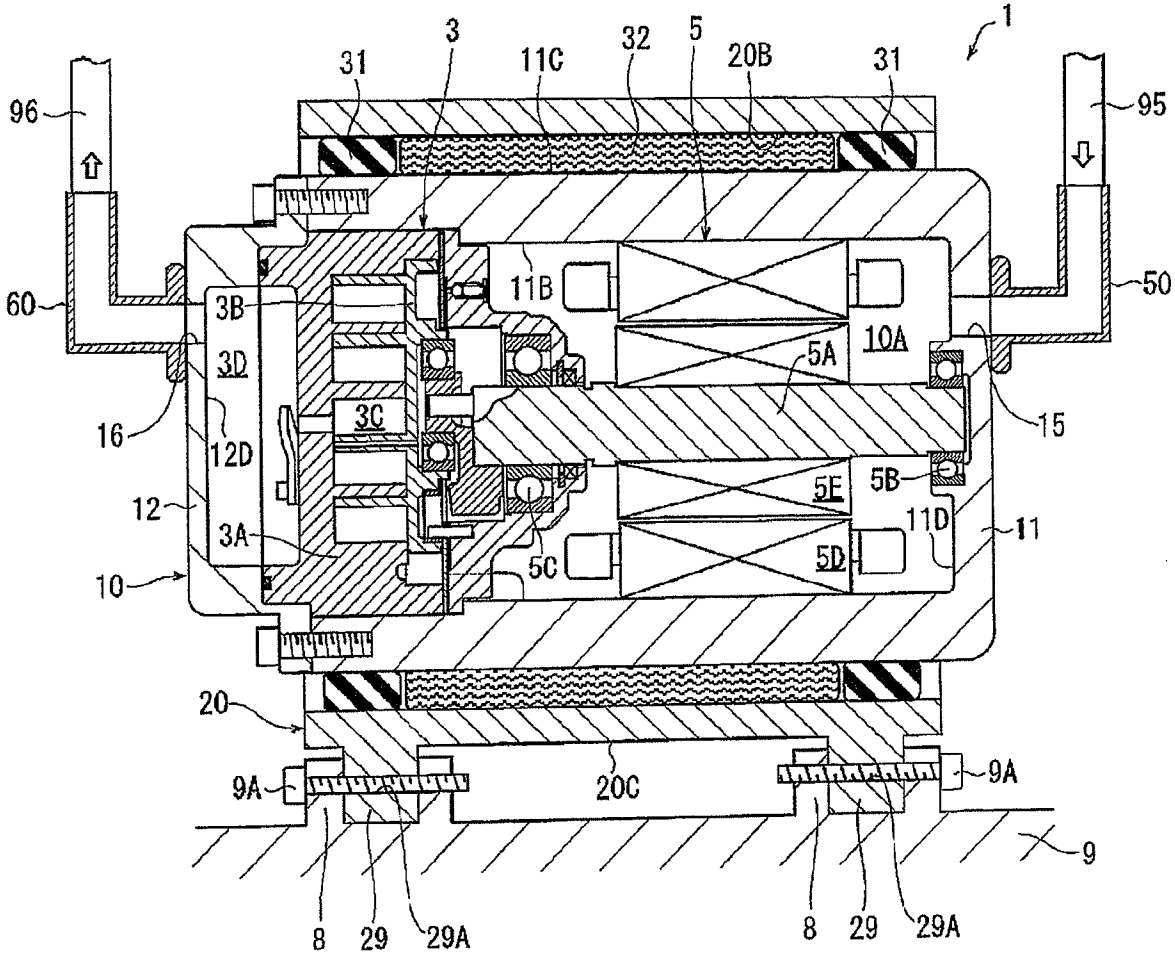
FIG. 2 is a cross-sectional view of the motor-driven compressor of the first embodiment.
Figure 3:
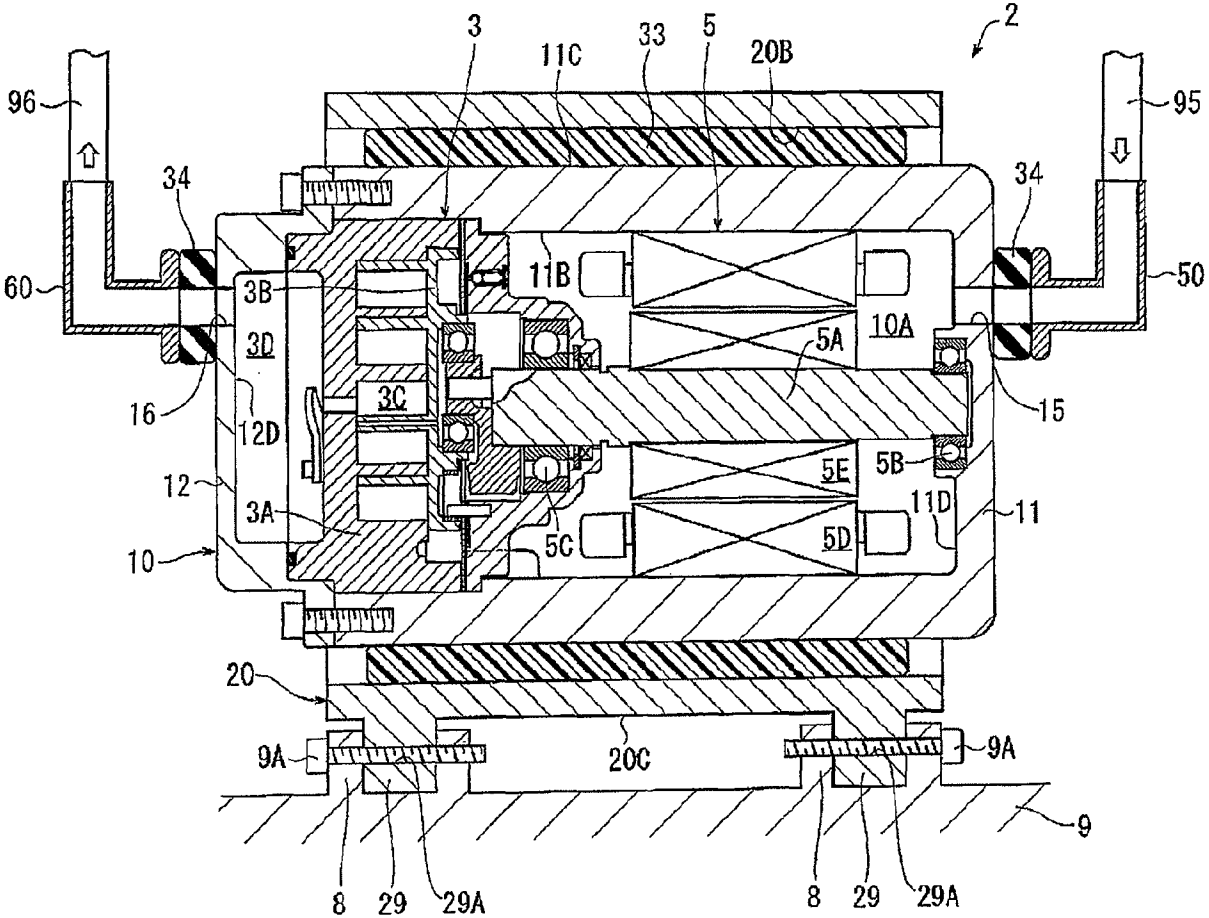
FIG. 3 is a cross-sectional view of a motor-driven compressor according to a second embodiment of the present invention.

As shown in FIG. 2, the motor-driven compressor 1 includes a compressor mechanism 3, a motor mechanism 5, an inner housing 10, and an outer housing 20. The inner housing 10 accommodates the compressor mechanism 3 and the motor mechanism 5 in a sealed state. The outer housing 20 accommodates the inner housing 10.

In the present embodiment, the inner housing 10 includes a first housing 11, which includes an open rear end (left end as viewed in FIG. 2), and a second housing 12, which closes the rear end of the first housing 11. The compressor mechanism 3 includes a fixed scroll 3A, which is fixed to an inner circumferential surface 11B of the first housing 11, and a movable scroll 3B, which is arranged to face the fixed scroll 3A. The fixed scroll 3A and movable scroll 3B are engaged with each other and form a compression chamber 3C. A drive shaft 5A is accommodated in the first housing 11. The drive shaft 5A includes a distal portion (right side as viewed in FIG. 2) supported in a rotatable manner by a bearing 5B, and a proximal portion (left side as viewed in FIG. 2) supported in a rotatable manner by a bearing 5C.

The motor mechanism 5 is located closer to an end wall 11D of the first housing 11 than the compressor mechanism 3. A stator 5D is fixed to the inner circumferential surface 11B of the first housing 11. A drive circuit (not shown) supplies the stator 5D with three-phase current. A rotor 5E is arranged in the stator 5D. The rotor 5E is fixed to the drive shaft 5A. The rotor 5E is rotated and driven by the current supplied to the stator 5D. The drive shaft 5A, stator 5D, and rotor 5E form the motor mechanism 5.

Referring to FIGS. 1 and 2, when the motor mechanism 5 rotates and actuates the compressor mechanism 3, the compressor mechanism 3 draws refrigerant into the inner housing 10 through a suction pipe 95 and compresses the refrigerant. Then, the compressor mechanism 3 discharges the compressed refrigerant from the inner housing 10 through a discharge pipe 96.

Referring to FIG. 1, the switch valve 91 is connected to the motor-driven compressor 1 by the suction pipe 95 and the discharge pipe 96. Further, the switch valve 91 is connected to the passenger compartment exterior heat exchanger 92 by a pipe 97 and the passenger compartment interior heat exchanger 94 by a pipe 99. The expansion valve 93 is connected to the passenger compartment exterior heat exchanger 92 by a pipe 98A and the passenger compartment interior heat exchanger 94 by a pipe 98B.

The switch valve 91, which is controlled by a control unit installed in the vehicle, can switch communication states of pipes. When the switch valve 91 communicates the discharge pipe 96 and pipe 97, and communicates the suction pipe 95 and pipe 99, the refrigerant discharged from the motor-driven compressor 1 through the discharge pipe 96 flows in direction D1 as shown in FIG. 1. When the switch valve 91 communicates the discharge pipe 96 and pipe 99, and communicates the suction pipe 95 and pipe 97, the refrigerant discharged from the motor-driven compressor 1 through the discharge pipe 96 flows in direction D2 as shown in FIG. 1.

The passenger compartment exterior heat exchanger 92 dissipates heat to or absorbs heat from the ambient air. The passenger compartment interior heat exchanger 94 dissipates heat to or absorbs heat from the air in the passenger compartment. The passenger compartment exterior heat exchanger 92, the passenger compartment interior heat exchanger 94, and the expansion valve 93 are known in the art and will not be illustrated or described in detail.

As shown in FIG. 2, the inner housing 10 includes a sealed cavity 10A, which accommodates the compressor mechanism 3 and motor mechanism 5 in a sealed state. The inner housing 10 is generally cylindrical and elongated in the direction in which the compressor mechanism 3 and the motor mechanism 5 are arranged. The inner housing 10 may be formed from a single member or a plurality of members coupled to each other to define the sealed cavity 10A. To obtain the durability required for the inner housing 10 to endure the vibration and heat, which are generated from the compressor mechanism 3 and motor mechanism 5, and the high-temperature and high-pressure refrigerant, it is preferable that the inner housing 10 be formed from a metal, such as steel or aluminum.

The compressor mechanism 3 and the motor mechanism 5 are fixed in the sealed cavity 10A by undergoing a known fastening process, such as shrinkage fitting, pressurized fitting, or bolt fastening. A fastening structure involving such a fastening process fixes the compressor mechanism 3 and the motor mechanism 5 with high rigidity. However, it is difficult to attenuate vibration and noise generated by the compressor mechanism 3 and motor mechanism 5 with such a structure. As a result, the vibration and noise of the compressor mechanism 3 and motor mechanism 5 are easily transmitted to the inner housing 10. Heat is also easily transmitted from the compressor mechanism 3 and the motor mechanism 5 to the inner housing 10.

A suction port 15 extends through the end wall 11D of the first housing 11. A suction coupling 50, which serves as an outer pipe, is fixed to the suction port 15. A refrigerant supply passage is formed in the sealed cavity 10A between the suction port 15 and the compressor mechanism 3.

A discharge chamber 3D is defined between the first housing 11 and the second housing 12. The second housing 12 includes an end wall 12D through which a discharge port 16 extends. A discharge coupling 60, which serves as an outer pipe, is fixed to the discharge port 16.

The suction coupling 50 and discharge coupling 60 are known pipe couplings. The suction pipe 95 is coupled to the suction coupling 50. The discharge pipe 96 is coupled to the discharge coupling 60.

The outer housing 20 is generally cylindrical and elongated in the direction in which the compressor mechanism 3 and the motor mechanism 5 are arranged. The outer housing 20, which accommodates the inner housing 10, may be formed from a metal, such as steel or aluminum, a resin, or a fiber reinforced resin. The outer housing 20 includes two open ends in the longitudinal direction. The suction coupling 50 and the discharge coupling 60 respectively project outward from the two open ends. The suction coupling 50 and the discharge coupling 60 are not in contact with the outer housing 20.

The outer housing 20 includes an outer wall surface 20C. Block-shaped mounting portions 29, which can be mounted to other members, are formed on the outer wall surface 20C. The mounting portions 29 project outward in the radial direction of the outer housing 20. An insertion hole 29A extends through each mounting portion 29 parallel to the longitudinal direction of the outer housing 20. A plurality of supports 8 project from a mounting object 9, such as a frame or engine of the vehicle. The mounting portions 29 are engaged with the supports 8. Bolts 9A are fastened to the mounting portions 29 and supports 8. This fixes the motor-driven compressor 1 to the mounting object 9. The fastening structure of the mounting portions 29, supports 8, and bolts 9A fix the outer housing 20 to the mounting object 9 with high rigidity. However, it is difficult to attenuate the vibration and noise transmitted from the outer housing 20 to the mounting object 9.

In the present embodiment, first intermediate members 31 and 32 are arranged between the inner housing 10 and the outer housing 20.

The first intermediate members 31 and 32 are formed from different materials. More specifically, the first intermediate members 31 have an anti-vibration property and is formed from an anti-vibration material, such as rubber, elastomer, resin, fiber reinforced resin, or silicon gel. In the present embodiment, the first intermediate members 31 are rubber annular bodies, or so-called O-rings. The first intermediate members 31 are arranged at the two longitudinal ends of the inner housing 10 and outer housing 20 in a compressed and deformed state between an inner wall surface 20B of the outer housing 20 and an outer wall surface 11C of the first housing 11. Thus, the first intermediate members 31 support the inner housing 10 in the outer housing 20.

The first intermediate member 32 has a thermal insulation property and is formed from a thermal insulation material, such as fiber mass of glass wool or the like, a foam material, cellulose fibers, or a vacuum insulation material. In the present embodiment, the first intermediate member 32 is a thick sheet of glass wool. The first intermediate member 32, which is wound around the outer wall surface 11C of the first housing 11, fills the void between inner wall surface 20B of the outer housing 20 and the outer wall surface 11C of the first housing 11. Thus, the first intermediate member 32 supports the inner housing 10 in the outer housing 20 in a supplemental manner. The first intermediate member 32 is sandwiched between the first intermediate members 31 and not exposed to the exterior from the two longitudinal ends of the inner housing 10 and outer housing 20.

The air conditioner, to which the motor-driven compressor 1 of the first embodiment is applied, adjusts the temperature of the passenger compartment as described below.

Referring to FIG. 1, when cooling the passenger compartment, the switch valve 91 communicates the discharge pipe 96 and pipe 97, and communicates the suction pipe 95 and pipe 99. As a result, the high-temperature and high-pressure refrigerant compressed by the compressor mechanism 3 flows in direction D1. The refrigerant dissipates heat into the ambient air and liquefies at the passenger compartment exterior heat exchanger 92. Then, the pressure of the refrigerant is decreased at the expansion valve 93. Subsequently, the refrigerant absorbs heat from the air in the passenger compartment and vaporizes at the passenger compartment interior heat exchanger 94. This cools the air in the passenger compartment. The refrigerant then returns to the motor-driven compressor 1 via the pipe 99, the switch valve 91, and the suction pipe 95.

When heating the passenger compartment, the switch valve 91 communicates the discharge pipe 96 and pipe 99, and communicates the suction pipe 95 and pipe 97. As a result, the high-temperature and high-pressure refrigerant compressed by the compressor mechanism 3 flows in direction D2. The refrigerant dissipates heat into the air in the passenger compartment and liquefies at the passenger compartment interior heat exchanger 94. This heats the air in the passenger compartment. Then, the pressure of the refrigerant is decreased at the expansion valve 93. Subsequently, the refrigerant absorbs heat from the ambient air and vaporizes at the passenger compartment exterior heat exchanger 92. The refrigerant then returns to the motor-driven compressor 1 via the pipe 97, the switch valve 91, and the suction pipe 95.

In the motor-driven compressor 1 of the first embodiment, the compressor mechanism 3 and motor mechanism 5 are fixed to the inner housing 10 with high rigidity. Further, the mounting portions 29, the supports 8, and the bolts 9A fix the outer housing 20 to the mounting object 9 with high rigidity. Thus, if the transmission of vibration and noise cannot be suppressed between the inner housing 10 and the outer housing 20, the vibration and noise from the compressor mechanism 3 and motor mechanism 5 would be transmitted from the inner housing 10 and outer housing 20 to the mounting object 9 without being attenuated. This may adversely affect comfort in the environment of the passenger compartment. Further, if the transmission of heat between the inner housing 10 and outer housing 20 cannot be suppressed, the heat of the high-temperature and high-pressure refrigerant compressed by the compressor mechanism 3 would be dissipated to the exterior through the outer housing 20.

In this regard, the motor-driven compressor 1 of the first embodiment includes the first intermediate members 31 and 32, which have anti-vibration and thermal insulation properties and which are arranged between the inner housing 10 and the outer housing 20. Since the first intermediate members 31 have an anti-vibration property, the transmission of vibration and noise, generated by the compressor mechanism 3 and motor mechanism 5, from the inner housing 10 to the outer housing 20 and mounting object 9 is suppressed. The first intermediate members 32, which are formed from glass wool, also suppress the transmission of vibration and noise from the inner housing 10 to the outer housing 20.

Further, the first intermediate members 32 have a thermal insulation property. Thus, the heat of the high-temperature and high-pressure refrigerant compressed by the compressor mechanism 3 is not transmitted from the inner housing 10 to the first intermediate member 32 and the outer housing 20. Further, the first intermediate members 31, which are formed from rubber, also suppress the transmission of the heat of the refrigerant. Thus, the motor-driven compressor 1 prevents the heat from decreasing in the drawn in refrigerant and the discharged refrigerant. Accordingly, when the air conditioner functions as a heat pump and heats the passenger compartment, the temperature of the refrigerant flowing to the passenger compartment interior heat exchanger 94 can be increased. As a result, the passenger compartment interior heat exchanger 94 effectively dissipates heat to the air in the passenger compartment and exhibits sufficient heating performance.

The motor-driven compressor 1 of the first embodiment suppresses the transmission of vibration and noise to the exterior and exhibits sufficient heating performance when used in the heat pump.

The structure of the first embodiment also has the advantages described below.

The inner housing 10 accommodates the compressor mechanism 3 and the motor mechanism 5 in a sealed state. This allows the outer housing 20 to have a simple shape. Further, the first intermediate members 31 and 32 are arranged between the double-housing structure of the inner housing 10 and the outer housing 20. Thus, the mounting portions 29 of the outer housing 20 and the structure that fastens the compressor mechanism 3 and motor mechanism 5 to the inner housing 10 do not have to be provided with an anti-vibration property. This simplifies the structure of such parts.

The suction coupling 50 and the discharge coupling 60 respectively coupled to the suction port 15 and the discharge port 16 are fixed to the inner housing 10 without contacting the outer housing 20. Thus, the suction coupling 50 and discharge coupling 60 do not transmit vibration and noise from the compressor mechanism 3 and motor mechanism 5 to the outer housing 20 and its exterior. The suction coupling 50 and discharge coupling 60 also do not transmit the heat of the refrigerant to the outer housing 20. This ensures that the motor-driven compressor 1 has the advantages of the present invention.

In the present example, the intermediate members arranged between the inner housing 10 and the outer housing 20 are the first intermediate members 31, which have an anti-vibration property, and the first intermediate member 32, which has a thermal insulation property. This increases the types of materials that can be used for the first intermediate members 31 and 32 and reduces the material cost in comparison with when the intermediate members of are each formed by a single member having both anti-vibration and thermal insulation properties.

The first intermediate member 32, which is formed from a thermal insulation material, is arranged at the inner side between the inner housing 10 and the outer housing 20, and the first intermediate members 31, which are formed from an anti-vibration material, are arranged at the outer side between the inner housing 10 and the outer housing 20. Thus, the first intermediate members 31 closes the void between the inner housing 10 and the outer housing 20 and protects the first intermediate member 32 located between the inner housing 10 and outer housing 20. This prevents deterioration and loss of the material forming the first intermediate member 32 (e.g., glass wool) that may be caused by wind and rain.

The outer housing 20 has a simple cylindrical shape. This lowers the manufacturing cost. Further, the inner housing 10 can easily be accommodated in the outer housing 20. This simplifies the assembling of the motor-driven compressor.

Second Embodiment

A motor-driven compressor 2 of a second embodiment uses a first intermediate member 33 in lieu of the first intermediate members 31 and 32 of the first embodiment. In addition, second intermediate members 34 are arranged between the inner housing 10 and suction coupling 50 and the inner housing 10 and discharge coupling 60. Otherwise, the structure of the motor-driven compressor 2 is the same as that of the motor-driven compressor 1 of the first embodiment. Like or same reference numerals are given to those components that are the same as the corresponding components of the first embodiment.

The first intermediate member 33 is formed from a material having anti-vibration and thermal insulation properties. In the present example, the first intermediate member 33 is a cylinder having a thick wall of glass wool. The first intermediate member 33 fills the void between the inner wall surface 20B of the outer housing 20 and the outer wall surface 11C of the first housing 11.

The second intermediate members 34 are formed from a material having either one of an anti-vibration property and a thermal insulation property. In the present example, the second intermediate members 34 are rubber annular bodies having an anti-vibration property.

The motor-driven compressor 2 of the second embodiment has the same advantages as the first embodiment.

The first intermediate member 33 is formed from a single member having anti-vibration and thermal insulation properties. Thus, in comparison to when using the first intermediate members 31 and 32 of the first embodiment, the number of components is reduced and the assembling procedures are simplified.

The second intermediate member 34, which has an anti-vibration property, suppresses the transmission of vibration and noise from the compressor mechanism 3 and motor mechanism 5 between the inner housing 10 and suction coupling 50, and between the inner housing 10 and discharge coupling 60. The second intermediate members 34 suppress the transmission of heat from the refrigerant. Thus, in comparison with when the suction coupling 50 and discharge coupling 60 are directly fixed to the inner housing 10, the transmission of refrigerant heat is suppressed from the inner housing 10 via the suction coupling 50 and discharge coupling 60 to the exterior. As a result, the motor-driven compressor 2 has the advantages of the present invention.

It should be apparent to those skilled in the art that the present invention may be embodied in many other specific forms without departing from the spirit or scope of the invention. Particularly, it should be understood that the present invention may be embodied in the following forms.

The outer housing 20 does not have to be cylindrical and include two open ends. The outer housing 20 may encase the entire inner housing 10 and include only one open end.

The fastening structure and shapes of the mounting portions 29, the supports 8, and the bolts 9A are not limited to those of the above embodiments. Any structure can be employed as long as the mounting portions 29 can fix the motor-driven compressor 1 to the mounting object 9.

Figure 4:
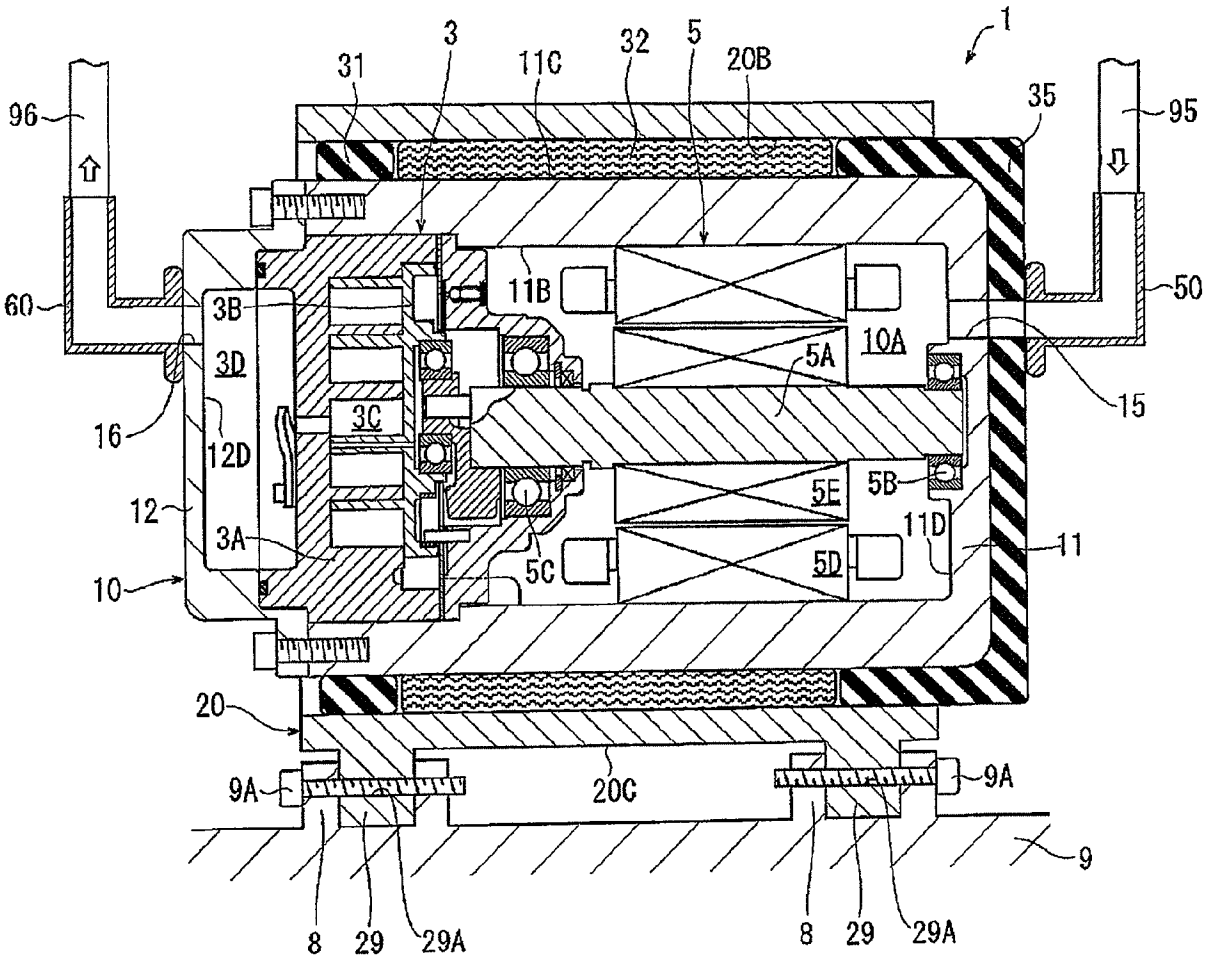
FIG. 4 is a cross-sectional view of a modified example of a motor-driven compressor according to the present invention.

In the first embodiment, the second intermediate member 34 of the second embodiment can be arranged between the suction port 15 and suction coupling 50 and/or between the discharge port 16 and the discharge coupling 60. Further, as shown in FIG. 4, the motor-driven compressor 1 may include an intermediate member 35, which integrates one of the first intermediate members 31 of the first embodiment with one of the second intermediate members 34 of the second embodiment. In this case, the part of the inner housing 10 that is not covered by the outer housing 20 is covered by the intermediate member 35. The intermediate member 35, which is formed from rubber, increases the covered region of the inner housing 10. This improves the thermal insulation effect. As a result, dissipation of the refrigerant heat from the inner housing 10 to the exterior is further suppressed.

In the second embodiment, the second intermediate member 34 may be arranged only between the suction port 15 and suction coupling 50 or only between the discharge port 16 and discharge coupling 60. Further, the intermediate member 33 may be formed integrally with the second intermediate member 34.

The compressor mechanism 3 is not limited to a scroll type and may be of a reciprocating type, a vane type, or any other known compression type.

The present examples and embodiments are to be considered as illustrative and not restrictive, and the invention is not to be limited to the details given herein, but may be modified within the scope and equivalence of the appended claims.

The invention claimed is:

1. A motor-driven compressor comprising:

a compressor mechanism that compresses a refrigerant;

a motor mechanism that actuates the compressor mechanism;

an inner housing that accommodates the compressor mechanism and the motor mechanism in a sealed state;

an outer housing that accommodates the inner housing, wherein the outer housing includes a mounting portion that can be mounted to another member, and the outer housing includes two opposing open ends in the longitudinal direction of the outer housing; and a first intermediate assembly arranged between the inner housing and the outer housing at longitudinal ends of the inner housing thereby sealing an interior space between the outer housing and the inner housing, wherein the first intermediate assembly includes an anti-vibration material having an anti-vibration property and thermal insulation material having a thermal insulation property, and the thermal insulation material is sandwiched in the longitudinal direction by the anti-vibration material, the anti-vibration material protrudes beyond the thermal insulation material in the longitudinal direction, wherein the inner housing protrudes beyond the first intermediate assembly in the longitudinal direction of the inner housing.

2. The motor-driven compressor according to claim 1, wherein the inner housing includes a suction port, which draws the refrigerant into the compressor mechanism, and a discharge port, which discharges the refrigerant from the compressor mechanism, outer pipes respectively coupled to the suction port and the discharge port, and each of the outer pipes is fixed to the inner housing without contacting the outer housing.

3. The motor-driven compressor according to claim 2, further comprising a second intermediate assembly arranged between at least one of the suction port and discharge port and an end of the corresponding outer pipe communicated with the at least one of the suction port and the discharge port, respectively, wherein the second intermediate assembly has at least one of an anti-vibration property and a thermal insulation property.

4. The motor-driven compressor according to claim 3, wherein the first intermediate assembly is integral with the second intermediate assembly.

5. The motor-driven compressor according to claim 1, wherein the outer housing is cylindrical.

6. The motor-driven compressor according to claim 1, wherein the anti-vibration material is formed of at least one of rubber, elastomer, resin, fiber reinforced resin, and silicon gel.

7. The motor-driven compressor according to claim 1, wherein the thermal insulation material is formed of at least one of glass wool, a foam material, cellulose fibers, and a vacuum insulation material.

8. The motor-driven compressor according to claim 1, wherein the first intermediate assembly comprises a rubber annular body.

9. The motor-driven compressor according to claim 1, wherein the inner housing protrudes beyond the open ends of the outer housing in the longitudinal direction of the outer housing.

* * * * *